US006428242B1

(12) United States Patent
Ward

(10) Patent No.: US 6,428,242 B1
(45) Date of Patent: Aug. 6, 2002

(54) FOLDING SUPPORT FOR REMOVABLE PIERS AND SIMILAR STRUCTURES

(76) Inventor: Terry D. Ward, 6450 E. McGuire Rd., Churubusco, IN (US) 46723

( * ) Notice: Subject to any disclaimer, the term of this patent is extended or adjusted under 35 U.S.C. 154(b) by 22 days.

(21) Appl. No.: 09/708,369

(22) Filed: Nov. 8, 2000

(51) Int. Cl.[7] ..... B63C 1/00

(52) U.S. Cl. ..... 405/220; 405/218; 405/202; 405/206; 114/263

(58) Field of Search ..... 405/221, 219, 405/218, 212, 220, 202, 206; 114/263, 219; 403/61, 93, 91, 92, 97, 348; 14/28, 75; 182/222

(56) References Cited

U.S. PATENT DOCUMENTS

| | | | | | |
|---|---|---|---|---|---|
| 1,039,986 | A | * | 10/1912 | Merritt | 403/61 |
| 1,041,147 | A | | 10/1912 | Murphy | |
| 1,461,813 | A | | 7/1923 | Wood | |
| 2,202,318 | A | * | 5/1940 | Ralston | 403/65 |
| 2,282,393 | A | | 5/1942 | Block | |
| 2,769,650 | A | * | 11/1956 | Larson | 108/125 |
| 2,838,353 | A | * | 6/1958 | Emmert | 108/125 |
| 2,873,987 | A | | 2/1959 | Larson | |
| 3,082,025 | A | * | 3/1963 | Larson | 108/129 |
| 3,572,045 | A | | 3/1971 | Owen | |
| 3,680,448 | A | | 8/1972 | Ballingall et al. | |
| 3,841,104 | A | | 10/1974 | Hufford | |
| 3,925,929 | A | | 12/1975 | Montgomery | |
| 3,968,992 | A | * | 7/1976 | Hogan | 297/162 |
| 4,022,027 | A | * | 5/1977 | Tetzner | 405/3 |
| 4,123,912 | A | * | 11/1978 | Meldrum | 14/10 |
| 4,349,297 | A | | 9/1982 | Misener | |
| 4,352,597 | A | | 10/1982 | Kay | |
| 4,611,945 | A | * | 9/1986 | Diego | 403/102 |
| 4,695,195 | A | | 9/1987 | Brande | |
| 4,776,726 | A | * | 10/1988 | Viles | 405/218 |
| 5,106,237 | A | * | 4/1992 | Meldrum | 405/221 |
| 5,584,606 | A | | 12/1996 | Hoogasian, Jr. | |

OTHER PUBLICATIONS internet search—www.dogpile.com/"removable Boat docking systems", hits www.dockrite.com,www.escape.ca/~dockplus/pp03.htm; www.sportdock.com; www.fendock-.com/Standard_docks.html.*

* cited by examiner

*Primary Examiner*—Heather Shackelford
*Assistant Examiner*—Katherine W Mitchell
(74) *Attorney, Agent, or Firm*—O'Malley and Firestone

(57) ABSTRACT

The removable pier support system of the present invention comprises a plurality of folding pier support posts. Each post has a platform section having a horizontal base plate for supporting the post on a bed of a body of water. The base plate has a lower surface which in use rests on the bed. An anchoring probe extends from the lower surface of the base plate, and a support arm section extends upwardly from the horizontal base plate. A folding arm section is coupled to the support arm section. The folding arm section is movable between a first position extending upwardly from the support arm section and a second lying adjacent the support arm section. A pivot mechanism couples the support arm section and the folding arm section to one another. The pivot mechanism comprises two sets of cooperating pins and slots with the pins disposed on one section and the slots positioned in the other. The pins are vertically aligned, and include a pivot pin and a locking pin. Each pin has a corresponding slot on the remaining section. The pivot pin of each set of pins is permanently retained in a closed slot through its respective section while the locking pin is insertable to and removable from a locking pin slot through an opening from an edge of the pier support side to the locking pin slot.

10 Claims, 7 Drawing Sheets

FOLDING SUPPORT FOR REMOVABLE PIERS AND SIMILAR STRUCTURES

BACKGROUND OF THE INVENTION

1. Field of the Invention

The present invention relates to piers used along lake and sea shores and, more particularly, to a foldable pier support suitable for underwater positioning to avoid ice damage during winter months.

2. Description of the Technical Field and Problem

In temperate and northern climates where lakes and rivers tend to freeze during winter, piers and docks left in the water can be exposed to ice and winter storm damage. A variety of marine dock structures have been proposed directed to enhancing the ease of installation and removal of these structures, with the objective of easing their removal from the water each fall and replacement each spring to protect the dock.

Many references in the prior art have been directed toward dock systems emphasizing light weight and modular construction, typically allowing the entire dock to be removed or reassembled quickly or easily. However, many lakeside residents prefer one position for their pier each vacation season, especially when good positions for the pier's footings have been located and the precise repositioning of a dock is not always easy. Under these circumstances, a system which does not require removal of all of the components of a dock can ease the burden of removal and replacement.

One patent directed to a system which leaves a portion of the pier in place in the water is U.S. Pat. No. 4,776,726 to Viles. Viles leaves most of the support structure for a pier in the water, excluding the modular decking sections. The pier is provided with at least a first pair of pivotable support legs, which may be rotated on hinges between an upright position to support the modular deck above the surface of the water and a lowered position under the surface of the water and below the maximum expected depth of ice in winter. The '726 patent provides an elaborate stanchion support system for some pairs of support legs, while other pairs of legs require positioning of a deck section on them to maintain an upright position. See column 3, lines 28–46 of the '726 patent.

Another dock system providing for submergence of a portion of the dock for the off season is taught by U.S. Pat. No. 5,106,237 to Meldrum. The system is a relatively elaborate system of folding legs, cross members and braces.

Simplification of the folding, or lowerable, portions of a dock system intended to be left in the water is desirable. Also desirable is a system which does not depend upon pier support bracing coming from removable dock components.

SUMMARY OF THE INVENTION

The removable pier support system of the present invention comprises a plurality of folding pier support posts. Each post comprises a platform section having a horizontal base plate for supporting the post on a bed of a body of water. The base plate has a lower surface which in use rests on the bed. An anchoring probe extends from the lower surface of the base plate, and a support arm section extends upwardly from the horizontal base plate. A folding arm section is coupled to the support arm section. The folding arm section is movable between a first position extending upwardly from the support arm section and a second lying adjacent the support arm section. A pivot mechanism couples the support arm section and the folding arm section to one another. The pivot mechanism comprises two sets of cooperating pins and slots with the pins disposed on one section and the slots positioned in the other. The pins are vertically aligned, and include a pivot pin and a locking pin. Each pin has a corresponding slot on the remaining section. The pivot pin of each set of pins is permanently retained in a closed slot through its respective section while the locking pin is insertable to and removable from a locking pin slot through an opening from an edge of the pier support side to the locking pin slot.

Additional effects, features and advantages will be apparent in the written description that follows.

BRIEF DESCRIPTION OF THE DRAWINGS

The novel features believed characteristic of the invention are set forth in the appended claims. The invention itself however, as well as a preferred mode of use, further objects and advantages thereof, will best be understood by reference to the following detailed description of an illustrative embodiment when read in conjunction with the accompanying drawings, wherein:

DETAILED DESCRIPTION OF THE INVENTION

Figure 1:
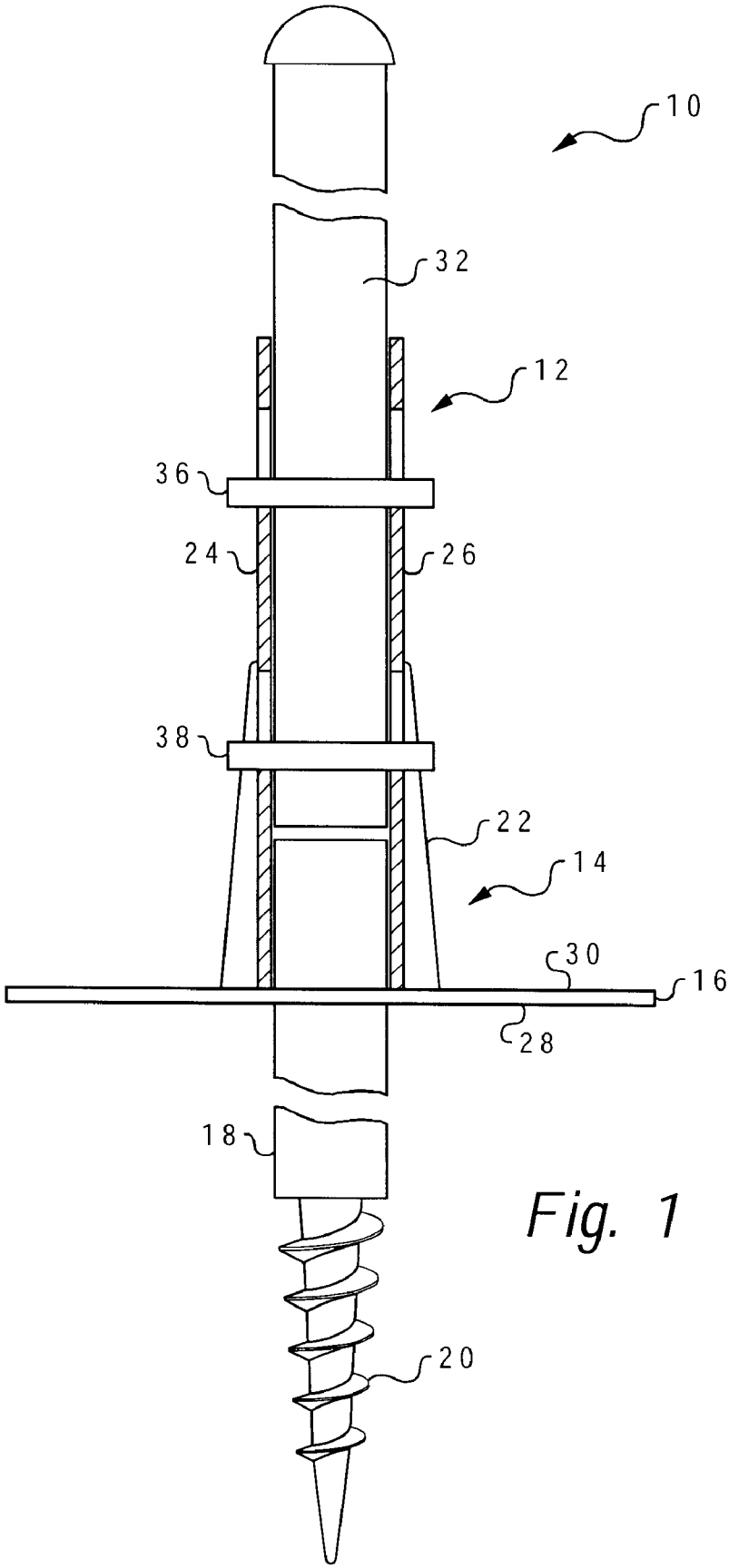
FIG. 1 is a front elevation of a pier support in accordance with one embodiment of the invention.

Referring now to the drawings, and particularly to FIG. 1, the invention is illustrated with reference to a preferred embodiment. A pier support 10 comprises two major sections including an upper, folding arm section 12 and a lower platform section 14. Folding arm section 12 is pivotally mounted on platform section 14 in a way which, when erected into an upright position, is locked in that position and can be used to support a removable dock or pier. Folding arm section 12 may be lifted and then folded over to a position which brings all of pier support 10 below both the surface of a body of water and below the expected freeze line for ice on the body of water.

Platform section 14 provides a base for the pier support on the bed of a lake or other body of water in a way which substantially immobilizes platform section. Platform section 14 includes a horizontal base plate 16, the lower major surface 28 of which can rest on a muddy or sandy lake bed to prevent the pier support 10 from sinking. A metal tube or beam 18 passes through base plate 16 from upper major surface 30 to lower major surface 28. In the preferred embodiment, an auger 20 extends downwardly from the bottom of the beam 18 and serves to anchor pier support 10 in the lake bed, particularly a muddy lake bed. For some applications, such as when the lake bed is stoney, auger 20 may not be used.

Extending upwardly from the upper major surface 30 are support elements for the attachment of folding arm section 12. Extending upwardly from opposed sides of beam 18 are two ears 24 and 26, formed from thin, rectangular metal bars placed on end and welded to the major upper surface 30. Ears 24 and 26 are braced against beam 18, which is centered on horizontal baseplate 16, and against a tapered back brace 22. Shown in partial phantom are support pins 36 and 38. Support pins 36 and 38 are mounted in a shaft 32, which is the major constituent element of folding arm section 12. As explained below, support pins 36 and 38 fit into slots in ears 24 and 26 to support folding arm section 12 from platform section 14. Upper support pin 36 provides a vertically positionable pivot on which upper folding arm may be rotated. Lower support pin 38 is aligned in the direction of elongation with upper support pin 36 and provides for both support and for locking of the shaft 32 against rotation.

Figure 2:
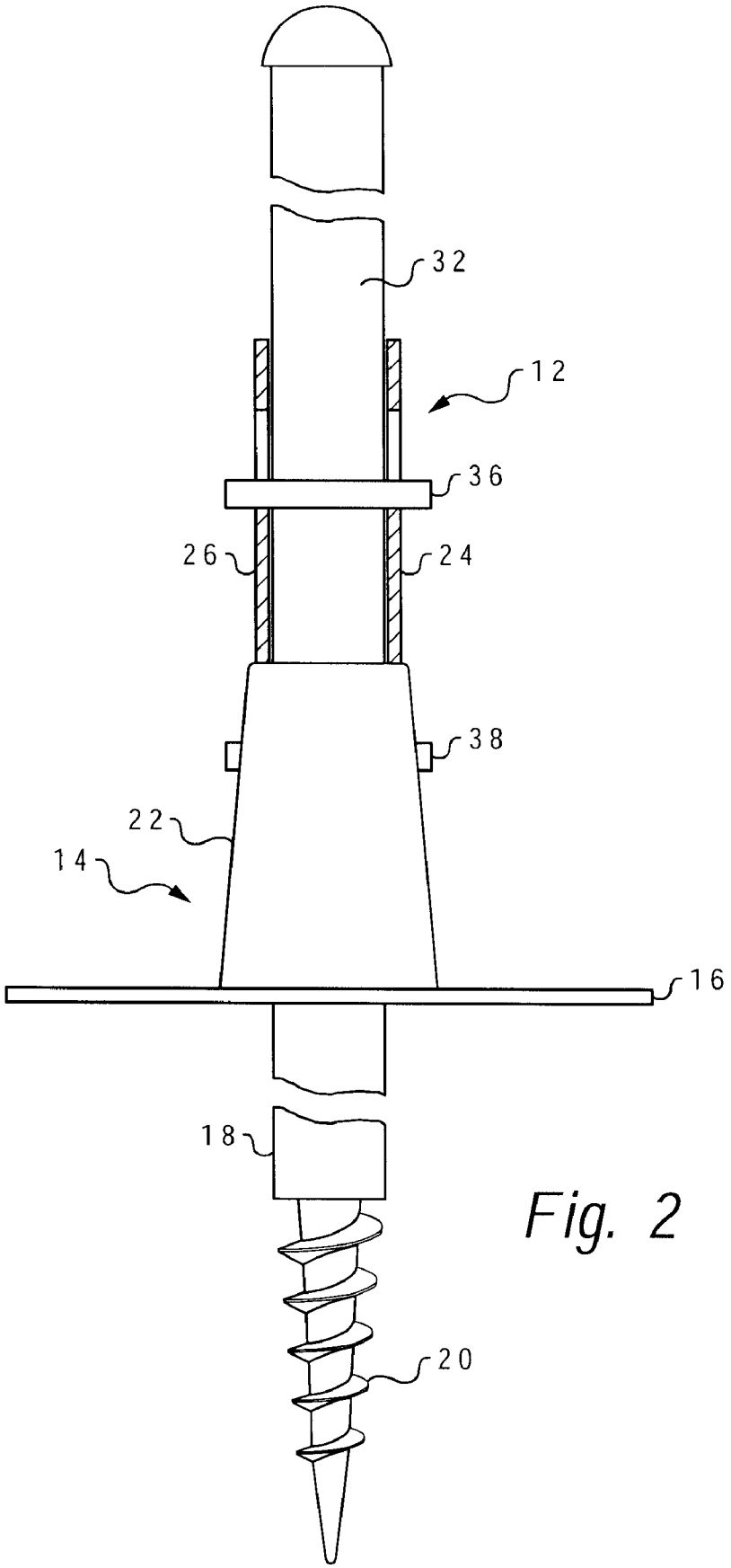
FIG. 2 is a rear elevation of the pier support of FIG. 1.
Figure 5:
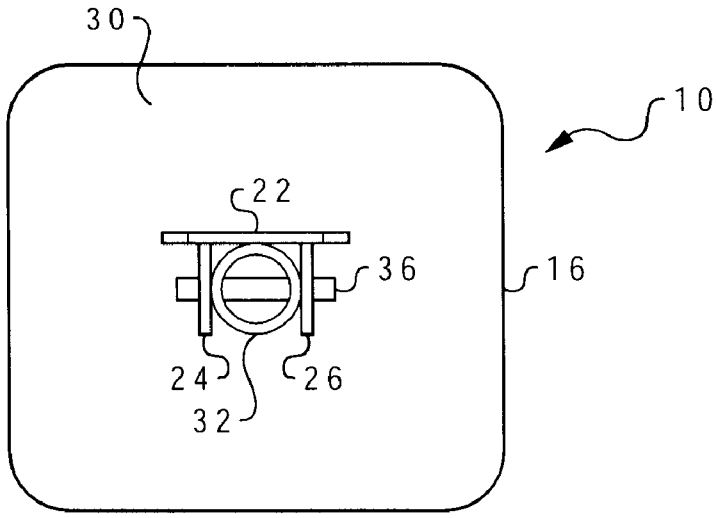
FIG. 5 is a top view of the pier support.

FIG. 2 better illustrates back support brace 22, a roughly trapezoidal shaped plate mounted on the edge forming its wide end on the upper major surface 30 of horizontal base plate 16 and positioned to present a supporting major surface along the rear edges of ears 24 and 26 (as illustrated in FIG. 5).

Figure 3:
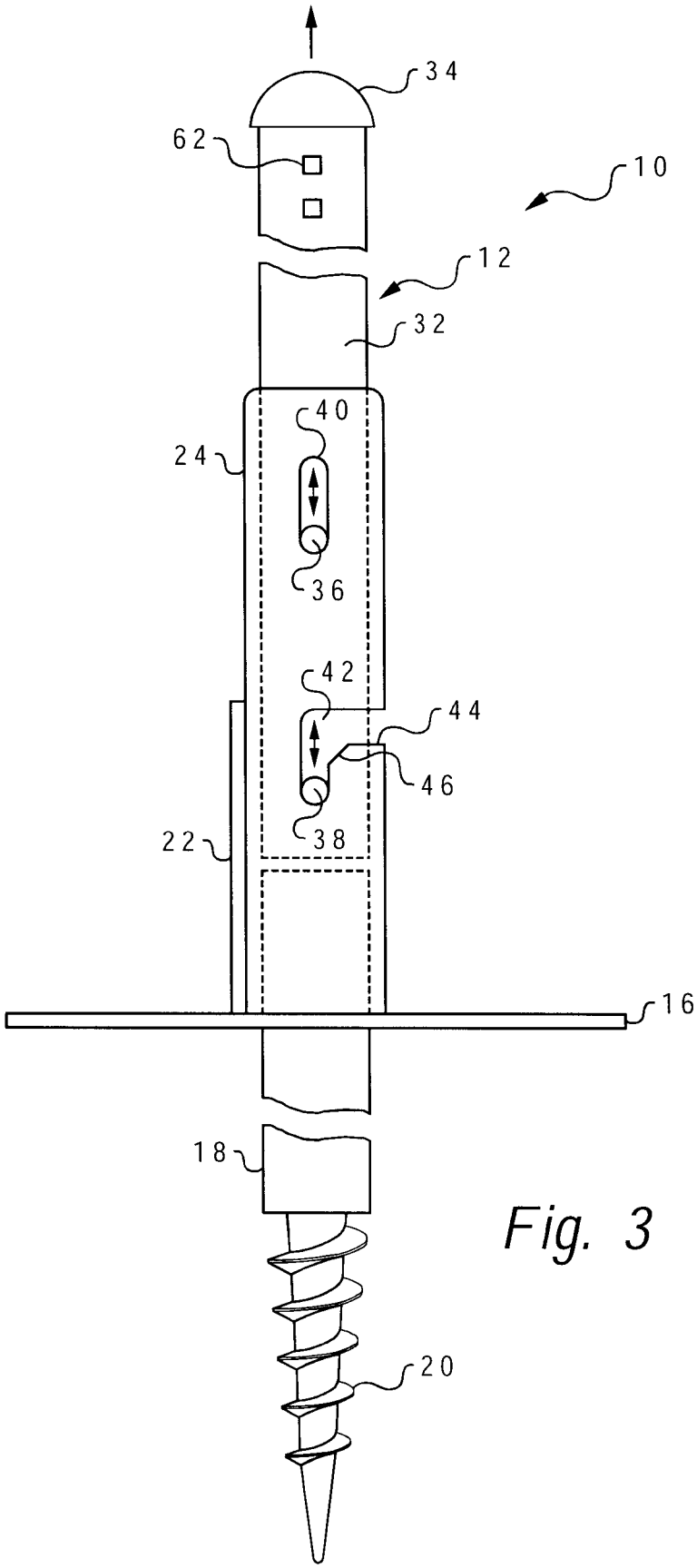
FIG. 3 is a side elevation of the pier support.

FIG. 3 presents a side elevation of pier support 10. Pier support 10 is symmetric side to side, and accordingly only the side illustrating ear 24 is shown. Ear 24 is pierced by two slots, an upper pivot slot 40 in which upper support pin 36 can be vertically moved as indicated by the double headed arrow and a lower locking slot 42 in which lower support pin can be positioned to lock folding arm section 12 against folding. Slot 40 and the main course of slot 42 are vertically aligned on and vertically oriented in ear 24. Upper support pin 36, which is permanently captured in slot 40, can move up and down in slot 40 by lifting and dropping shaft 32. The bottoms of slots 40 and 42 are spaced to match the spacing between pins 36 and 38 so that shaft 32 is supported by both pins resting on the bottom ends of their respective slots when the shaft is lowered on ear 24. When pins 36 and 38 are at the bottom of slots 40 and 42, shaft 32 is locked into a positioned aligned with ear 24 (and ear 26). In this position a collar 56 (discussed below) may be lowered around shaft 32, after removal of a shaft cap 34, as described and illustrated below. A plurality of keyholes 62 running vertically along an upper portion of shaft 32 provide points to position locking pins through collars 56 and the shaft.

Figure 4:
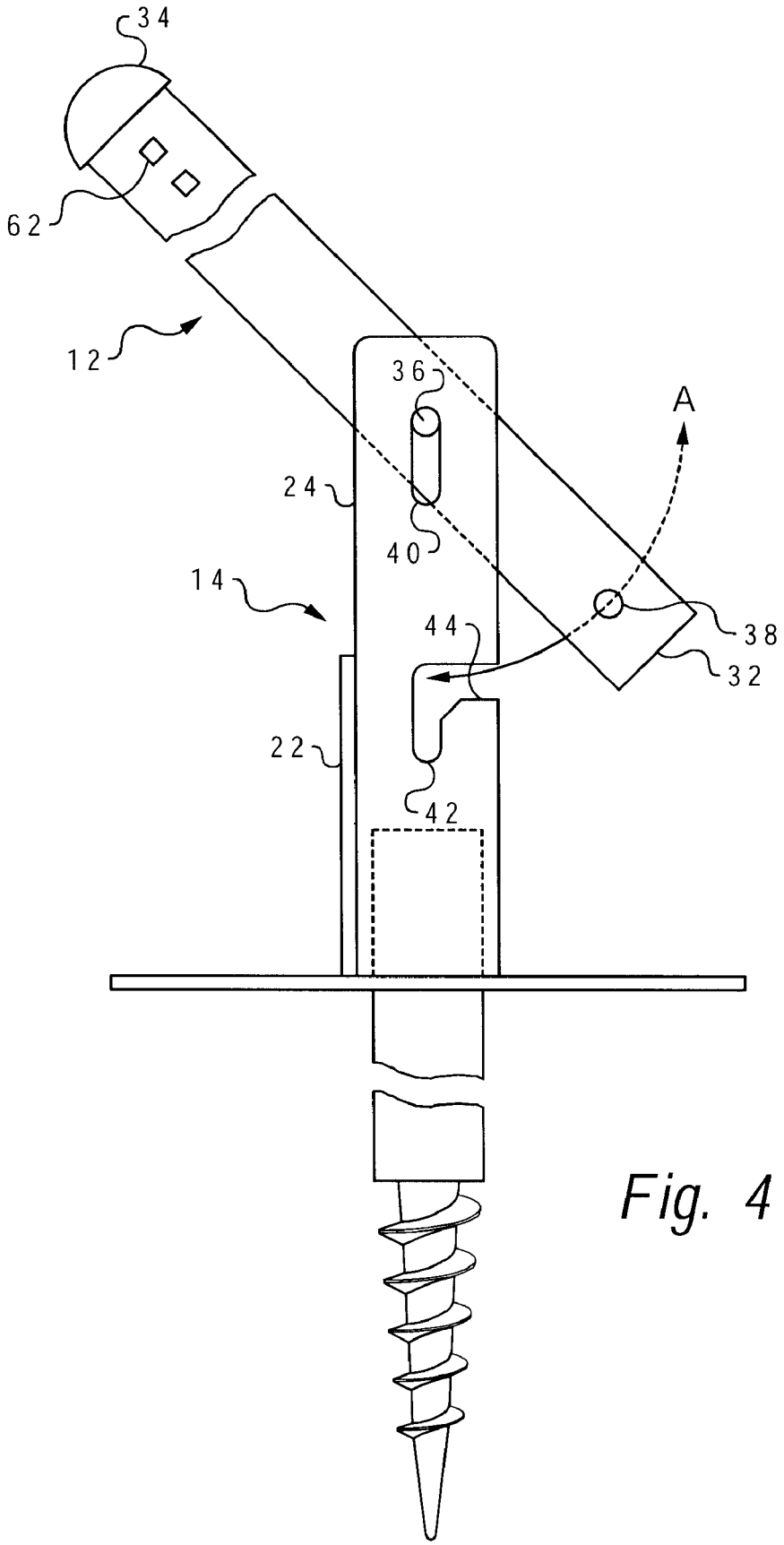
FIG. 4 is another side elevation illustrating the folding aspect of the invention.

FIG. 4 illustrates the pivoting of folding arm section 12. In practice, folding arm 12 may be moved so that the bottom portion of shaft 32 swings outwardly from the front side of platform section 14 and the upper portion folds over toward the back side of the platform section, typically to a position with cap 34 resting on the lake bed. In order to rotate shaft 32 in the directions indicated by arc A, with pin 38 moving into and out of engagement with slot 42 through a forward opening 44 into slot 42, shaft 32 is raised to bring pin 36 up against the top of slot 40. Pin 38 can then be moved along the arc and into and out of engagement with slot 42 through opening 44 along the forward edge of ear 24. When shaft 32 is vertically aligned with pin 38 in slot 42, the shaft may be dropped positioning pins 36 and 38 at the bottoms of slots 40 and 42, respectively, and thereby preventing rotation of the shaft.

FIG. 5 is a top view of the pier support 10 of the present invention showing a circular cross-section shaft 32 mounted between ears 24 and 26 on upper support pin 36. The position of back brace 22 flat against back edges of ears 24 and 26 is also illustrated.

Figure 6:
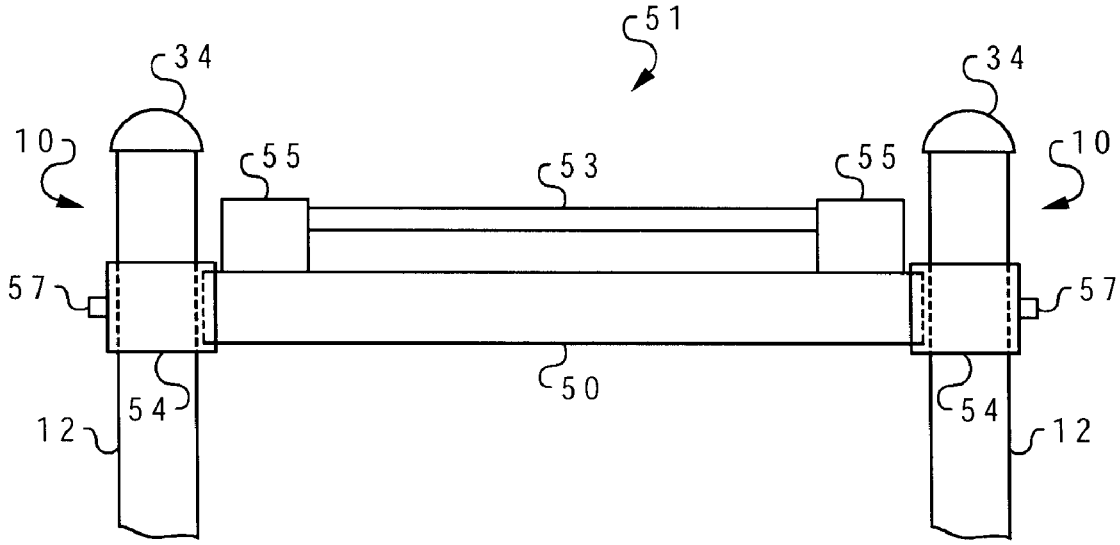
FIG. 6 is an illustration of the manner of use of the pier support of the invention.

FIG. 6 illustrates an application of the inventive pier support to construction of a section of a pier 51. A pair of pier supports 10 are positioned spaced apart to receive collars 54. Locking pawls 57 may be used to support the vertical position of collars 54 on the upper folding arms 12 of the pier supports. A cross support 50 is inserted between and supported by collars 54. Resting on cross support 50 is a section of decking 51 comprising side support rails 55 and planking 53.

Figure 7A:
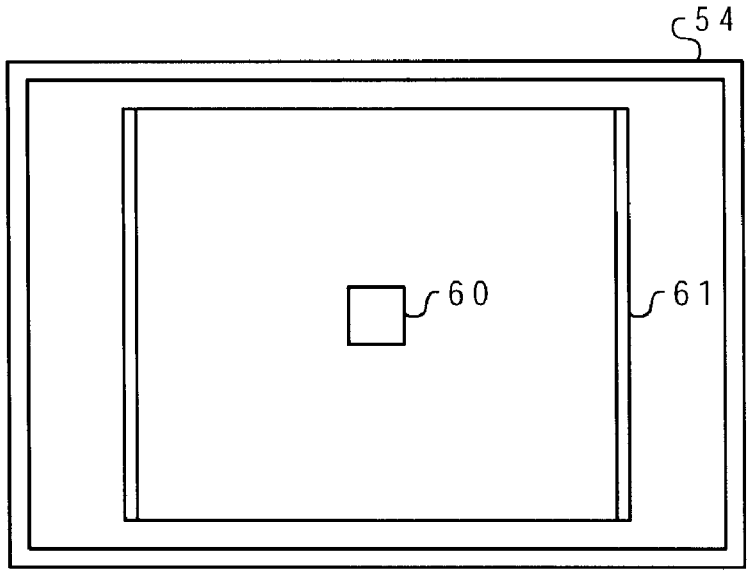
FIGS. 7A–B are side elevations of support collar which may be fit around the pier support.
Figure 7B:
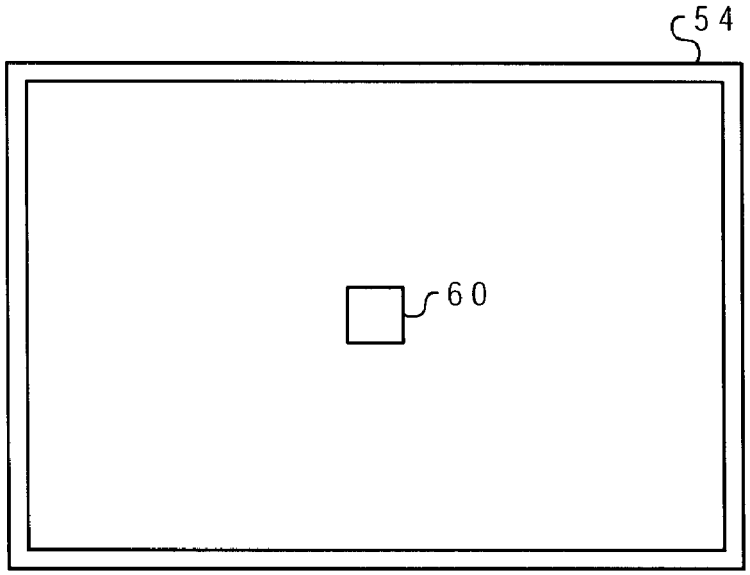
Figure 8:
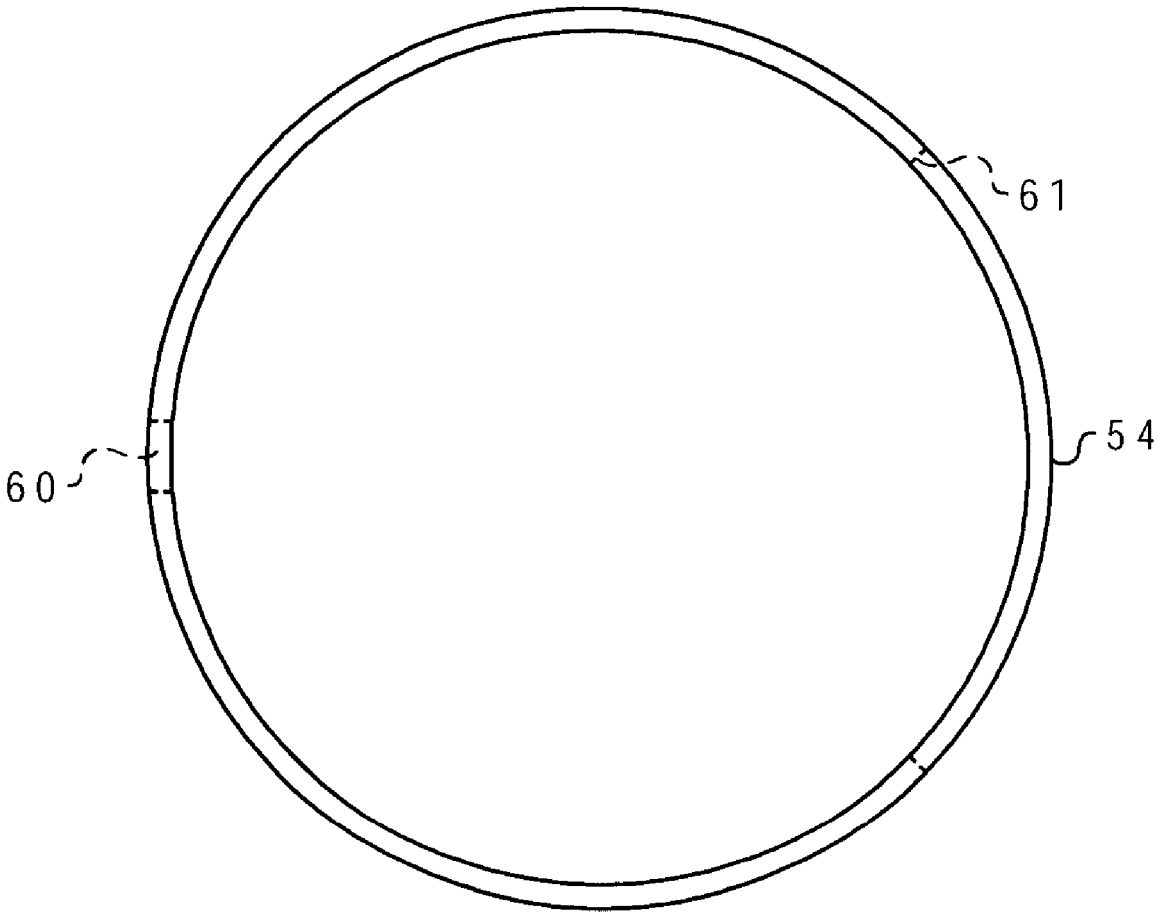
FIG. 8 is a top view of the support collar of FIGS. 7A–B.

FIGS. 7A–B and 8 depict a representative collar 54 which is adapted to receive one end of a cross support 50. Collar 54 is a section of a hollow cylinder, open at each end and sized to fit snugly around a shaft 32 of the pier support. The cylinder wall is pierced at diametrically opposed positions by a cross support receiving aperture 61 and by an aperture 60 sized to accept a pawl 57 used to lock the collar at a vertical position on a pier support 10. Those skilled in the art will now realized that a wide variety of structures may be used to provide such support.

The present invention provides a mechanically simple pier support post which may be folded and left in position on a lake or stream bottom during winter seasons. Conventional pier decking and supports may be removed from the supports for off season storage and easily replaced on the pier supports during spring by reerecting the pier supports to position the upper portions of the supports above the surface level of the water.

While the invention is shown in only one of its forms, it is not thus limited but is susceptible to various changes and modifications without departing from the spirit and scope of the invention.

What is claimed is:

1. A pier support system for a removable pier, comprising:

a plurality of pier support posts, each comprising;

a base section having a horizontal base plate having a lower surface for resting on a bed of a body of water, and a support arm section having two parallel sides extending upwardly from the horizontal base plate, a folding arm section coupled to the support arm section along the two parallel sides and positionable in a first position extending upwardly from the support arm section and a second lowered position, and a pivot mechanism coupling the support arm section to the folding arm section, the pivot mechanism comprising a cooperating pin and slot arrangement including two sets of pins and slots, each set being disposed between a different one of the two parallel sides of the support arm structure and portions of the folding arm section adjacent thereto, each set further comprising a pivot pin disposed in a closed slot and a locking pin insertable to and removable from a partially opened slot; and a height adjustable cross support fitable between pairs of pier support posts.

2. A pier support system as claimed in claim 1, the base section further comprising an anchoring probe extending from the lower surface of the base plate.

3. A pier support system as claimed in claim 2, each pier support post further comprising:

the pivot and locking pins of each set being disposed to extend outwardly from opposed sides of the folding arm section;

the opposed parallel sides of the supporting arm section having ears extending upwardly along opposed sides of the supporting arm section relatively outside of the opposed sides of the folding arm section; and one closed and one partially opened slot being disposed in each ear.

4. A pier support system as claimed in claim 3, each pier support post further comprising:

the partially opened slot of each set being vertically oriented with an opening to the slot being formed in an upper end of the slot and oriented toward one side of the ear;

the closed and partially opened slots of each set being vertically aligned to allow vertical movement of pins positioned therein, and to further allow the folding arm section to be lifted upwardly from a resting position with the pins lying on the bottoms of the respective slots to a position with the pins in the upper portions of the slots allowing the folding arm section to be rotated on the pivot pins while the locking pins swing through the opening to the partially opened slots.

5. A pier support system as claimed in claim 4, each pier support post further comprising:

the closed slot being above the partially opened slot.

6. A pier support system as claimed in claim 5, wherein the anchoring probe of each pier support post includes a downwardly oriented auger screw.

7. A pier support post comprising:

first and second shafts;

the first shaft having a pair of ears extending from one end thereof bracketing the second shaft, each ear of the first shaft having a pair of slots aligned with and elongated in the direction of elongation of the first shaft;

the second shaft having a pair of outwardly oriented pins on each side adjacent each of the ears, one of the pins of each pair being permanently captured in one of the pair of slots in the adjacent ear, and a second of the pins of each pair being positionable in and removable from a second slot when the second shaft is positioned to place the first pin at one end of its travel in the first slot and the second shaft is rotated relative to the first shaft on the first pins of both pairs of pins; and a support plate supporting one of the shafts perpendicularly from a major face of the support plate; and an auger anchor extending perpendicularly from an opposite facing major face of the support plate.

8. A pier support post as claimed in claim 7, wherein the first shaft is supported on the support plate.

9. A pier support post as claimed in claim 8, wherein the second shaft is extended on the first shaft to position the first pins at the limit of their travel and thereby allow the second shaft to be rotated on the pins between a position aligned with the first shaft and a position out of alignment with to the first shaft.

10. A pier support post as claimed in claim 9, wherein the support plate includes an auger anchor extending perpendicularly in a direction opposite to the shaft supported on the support plate.

* * * * *